US008086342B2

(12) United States Patent
Gotti et al.

(10) Patent No.: US 8,086,342 B2
(45) Date of Patent: Dec. 27, 2011

(54) METHOD FOR CONTROLLING THE TENSION OF THE YARN UNWINDING FROM A NEGATIVE YARN-FEEDER FOR TEXTILE MACHINES, AND APPARATUS FOR CARRYING OUT SUCH METHOD

(75) Inventors: Luca Gotti, Albino (IT); Giovanni Pedrini, Leffe (IT)

(73) Assignee: L.G.L. Electronics S.p.A., Gandino (IT)

( * ) Notice: Subject to any disclaimer, the term of this patent is extended or adjusted under 35 U.S.C. 154(b) by 862 days.

(21) Appl. No.: 12/213,261

(22) Filed: Jun. 17, 2008

(65) Prior Publication Data

US 2009/0057464 A1 Mar. 5, 2009

(30) Foreign Application Priority Data

Aug. 31, 2007 (EP) ..... 07425547

(51) Int. Cl.
*G06F 19/00* (2011.01)

(52) U.S. Cl. ..... 700/140; 139/256 R; 139/194

(58) Field of Classification Search ..... 700/140, 700/143; 139/194, 256 R, 450, 452
See application file for complete search history.

(56) References Cited

U.S. PATENT DOCUMENTS 5,398,732 A * 3/1995 Zenoni et al. ..... 139/450
5,476,122 A * 12/1995 Schuster et al. ..... 139/194
5,544,680 A * 8/1996 De Ro ..... 139/450
5,553,641 A * 9/1996 Zenoni ..... 139/452
6,328,081 B1 * 12/2001 Gotti et al. ..... 139/450
6,467,512 B1 * 10/2002 Meyer et al. ..... 139/435.2
7,584,014 B2 * 9/2009 Gotti et al. ..... 700/140

FOREIGN PATENT DOCUMENTS

EP 0 536 088 A 4/1993
EP 0 622 485 A 11/1994
EP 0 707 102 A 4/1996
EP 1 106 721 A 6/2001

* cited by examiner

*Primary Examiner* — Danny Worrell
*Assistant Examiner* — Larry Worrell, Jr.
(74) *Attorney, Agent, or Firm* — Modiano & Associati; Albert Josif; Daniel J. O'Byrne

(57) ABSTRACT

The tension is modulated by a weft-braking device controlled by a tension control block programmed for comparing the measured tension with a reference tension, and for transmitting a braking level signal to the weft-braking device, which braking level signal is adapted to minimize the difference between the measured tension and the reference tension. The yarn consumption speed is calculated, then the yarn consumption speed is compared with a predetermined threshold speed, and if the calculated consumption speed overcomes the predetermined threshold value, the tension control block is enabled, while, if the calculated consumption speed is lower than the threshold value, the tension control block is disabled and the last signal generated by the latter is maintained as braking signal, until the yarn consumption speed overcomes again the threshold value.

8 Claims, 2 Drawing Sheets

METHOD FOR CONTROLLING THE TENSION OF THE YARN UNWINDING FROM A NEGATIVE YARN-FEEDER FOR TEXTILE MACHINES, AND APPARATUS FOR CARRYING OUT SUCH METHOD

The present invention relates to negative yarn-feeders for textile machines, and more particularly to a method for controlling the tension of the yarn unwinding from the yarn-feeder and to an apparatus for carrying out such method.

BACKGROUND OF THE INVENTION

As known, the so-called "negative" yarn-feeders comprise a stationary drum on which a motorized swivel flywheel winds a plurality of yarn loops forming a weft reserve or stock. Upon request from the textile machine, the loops are unwound from the drum, then pass through a weft-braking device which controls the tension of the yarn, and finally are fed to the machine which, with regard to the present invention, preferably consists of a circular/rectilinear knitting machine of a conventional type.

The yarn-feeders of the above type, which are well-known to the person skilled in the art, have the main aim of maintaining the amount of yarn stored on the drum substantially constant, while minimizing the tension of the yarn delivered from the drum.

The amount of yarn stored on the drum is controlled by a triad of sensors. A first sensor, typically a Hall sensor, detects the passing of magnets attached to the flywheel in order to calculate the amount of yarn wound on the drum and the winding speed; a second sensor, generally a mechanical sensor, provides a binary information indicative of the presence or absence of a minimum amount of stocked loops in the area where the sensor is arranged; a third sensor, which can be, e.g., a optical sensor, a piezoelectric sensor, and the like, provides at least one pulse per each unwound loop, and is also used for calculating the amount of yarn wound on the drum and the winding speed.

While with the so-called "positive" yarn feeders such as the one described in EP-A-950742, the tension of the yarn is directly controlled by comparing a reference tension value with a measured tension value, and then by varying the yarn-feeding speed in such a way as to minimize the difference between such values, with the negative yarn feeders the tension is controlled either by weft-braking devices such as the one described in EP-B-534 263, or by devices having a simpler construction, such as brush-type brakes or so-called "duck-type" brakes of a conventional type.

In braking devices such as the one described in EP-B-622 485, the yarn is pressed between a fixed lamina and a movable braking member, which is also shaped as a lamina and is driven by a linear motor. In braking devices such as the one described in EP-B-1 059 375, the unwinding yarn is pressed between the delivery edge of the drum and a frustoconical, hollow braking member connected to a motor. In both cases, the motor which drives the braking member is controlled by a closed-loop control unit which modulates the braking action applied upon the yarn. The control unit receives a measured tension signal from a tension sensor arranged downstream of the feeder, and compares it with a reference tension indicative of the desired tension, by a control loop having the aim of minimizing the difference between the measured tension and the reference tension.

The above-described control system is designed to compensate the slow variations of tension due, for example, to wearing of the braking means, and is set to be substantially unaffected by small, sudden variations of tension caused, e.g., by the presence of a knot or by the passing of a length of yarn having an uneven section.

However, with certain operative conditions, e.g., at the starting of the weaving process, when the knitting machine is not running, or at the threading step, when the yarn is motionless, the above control system is subject to deceiving because the tension of the yarn unwinding from the feeder is much lower than the normal operative tension, and in certain cases it may be even equal to zero. In these cases, the control loop increases the intensity of the braking action more and more up to the uppermost braking level, without ever reaching the desired tension value. Consequently, when yarn is drawn from the drum again, such a high braking value causes the yarn tension to reach a peak that can give rise to textile defects and even to the breaking of the yarn.

SUMMARY OF THE INVENTION

Therefore, it is a main object of the present invention to improve the above-described method for controlling the yarn tension in such a way as to overcome the drawbacks deriving from particular operative conditions such as the above-described ones, where the yarn tension reaches very low levels, even equal to zero.

The above object and other advantages, which will better appear below, are achieved by the method having the features recited in claim 1, and by the apparatus having the features recited in claim 5, while the dependent claims state other advantageous, though secondary, features of the invention.

BRIEF DESCRIPTION OF THE DRAWINGS

The invention will be now described in more detail with reference to a few preferred, non-exclusive embodiments, shown by way of non limited example in the attached drawings, wherein.

DESCRIPTION OF THE PREFERRED EMBODIMENTS

Figure 1:
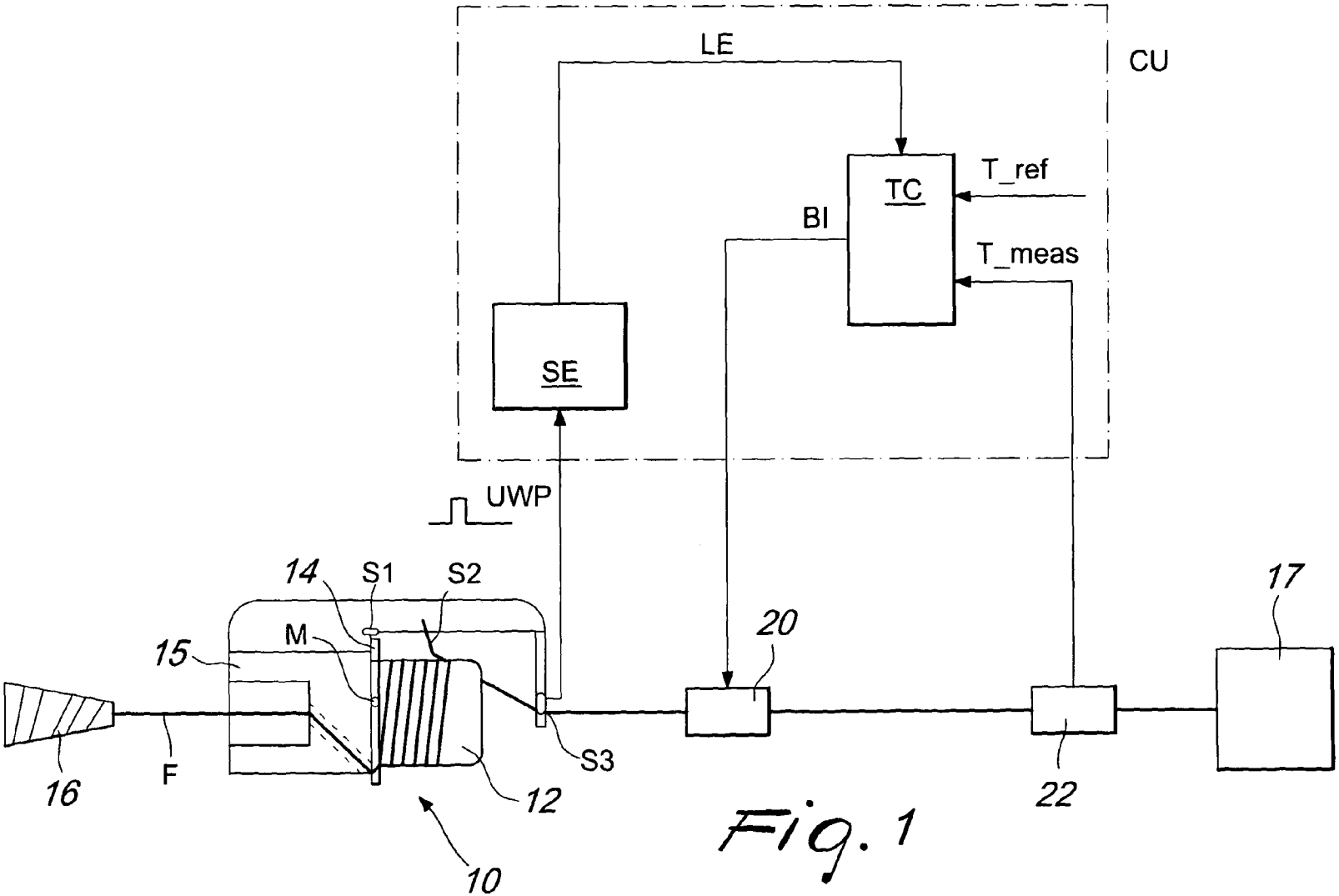
FIG. 1 is a block diagram showing the method according to the invention.

With initial reference to FIG. 1, a negative yarn-feeder 10 for textile machines comprises a stationary drum 12 and a swivel flywheel 14 driven by a motor 15, which draws yarn F from a reel 16 and winds it on a drum 12 in form of loops, which form a weft reserve or stock. Upon request from a general textile machine 17, yarn F is unwound from the drum and feeds the machine.

The amount of yarn stored on drum 12 is controlled by a triad of sensors. A first sensor S1, typically a Hall sensor, detects the passing of magnets such as M, which are attached to flywheel 14, in order to calculate the amount of yarn wound on the drum as well as the winding speed. A second sensor S2, generally a mechanical sensor, provides a binary information indicative of the presence or absence of a minimum amount of stock in an intermediate area of drum 12. A third sensor S3, preferably an optical sensor, provides a pulse UWP per each unwound loop.

Downstream of yarn-feeder 10, a weft-braking device 20 is arranged which is controlled by a control unit CU, which will be better described below, in order to control the tension of the yarn unwinding from drum 12 and to maintain the tension substantially constant. Downstream of weft-braking device 20, a tension sensor 22 is arranged, which controls the tension of yarn F unwinding from the drum and generates a measured tension signal T_meas.

Control unit CU comprises a tension control block TC which receives measured tension signal T_meas and is programmed to compare it with a reference tension T-ref indicative of the desired tension, and to generate a braking level signal BI which drives weft-braking device 20 in such a way as to vary the braking intensity in order to minimize the difference between the measured tension and the reference tension.

According to the present invention, tension control block TC is normally disabled, and control unit CU comprises a speed-estimating block SE which processes signals UWP from third sensor S3 in such a way as to calculate the actual speed of consumption of yarn as a function of the time intervals between such pulses UWP, and is programmed to generate an enabling signal LE which enables tension control block TC only when such speed overcomes a predetermined threshold value, which can even be equal to zero. On the contrary, when the calculated speed is lower than the threshold value, tension control block TC is disabled and braking level signal BI will be "frozen" at the value memorized at the immediately previous instant, until the speed overcomes again the threshold value and the tension control block will start again to operate by using the frozen value as first value.

Figure 2:
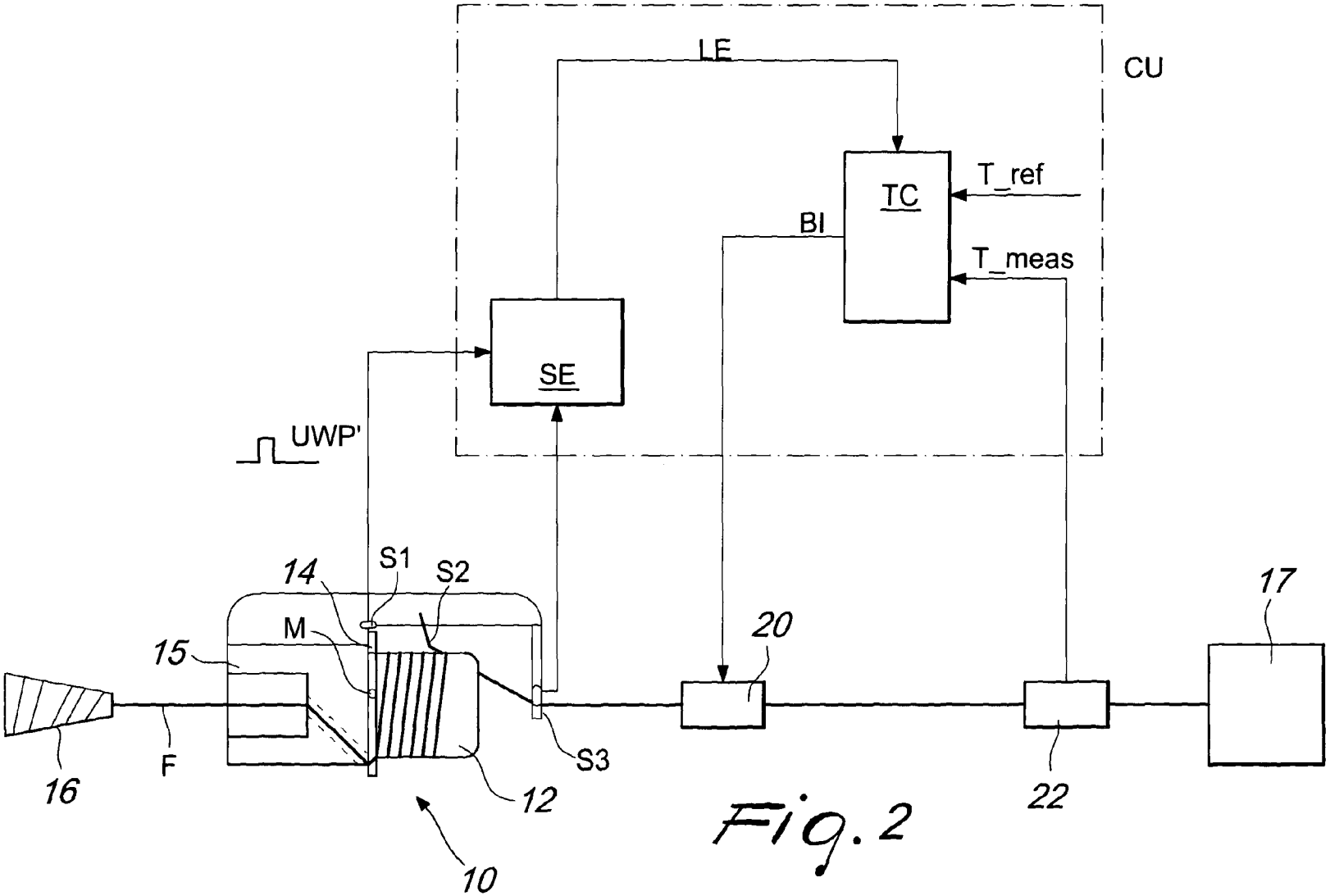
FIG. 2 is a block diagram showing the method according to an alternative embodiment of the invention.

With an alternative embodiment of the invention, shown in FIG. 2, speed-estimating block SE processes signals UWP' from first sensor S1 in order to calculate the weft-winding speed as a function of the time intervals between pulses UWP' generated by such sensor, and is programmed to generate an enabling signal LE which enables tension control block TC only when such speed overcomes a predetermined threshold value, which can even be equal to zero. On the contrary, when the calculated speed is lower than threshold value S, tension control block TC is disabled and braking level signal BI will be "frozen" at the value BIf memorized at the immediately previous instant, until the speed overcomes again the threshold value and the tension control block will start again to operate by using the frozen value as first value. With this second embodiment, the signal generated by first sensor S1, which detects the rotation of weft-winding flywheel 14, is used as indicative of the actual consumption of yarn, because it is assumed that, when feeder 10 is operative, the amount of yarn drawn from reel 16 corresponds to an equal amount of delivered yarn. A few preferred embodiments of the invention have been described herein, but of course many changes may be made by a person skilled in the art within the scope of the invention. In particular, although in the described embodiments tension control block TC is assumed to be disabled at rest and to be enabled by an enabling signal LE generated by speed-estimating block SE when the calculated speed overcomes the threshold value, of course the inverse solution will fall within the scope of the invention, i.e., in which tension control block TC is normally enabled and is disabled by a disabling signal LD generated by speed-estimating block SE when the calculated speed is lower than the threshold value. Furthermore, the sensor used for calculating the yarn-winding speed or the yarn-unwinding speed may be of different types with respect to what described above, e.g., piezoelectric sensors, provided that they are capable of generating signals usable by speed-estimating block SE for determining if the speed overcomes a predetermined threshold.

The disclosures in European Patent Application No. 07425547.2 from which this application claims priority are incorporated herein by reference.

What is claimed is:

1. A method for controlling the tension of the yarn unwinding from a negative yarn-feeder for textile machines, in which said tension is modulated by a weft-braking device controlled by a tension control block programmed for comparing a measured tension with a reference tension, and for transmitting a braking level signal to said weft-braking device, which braking level signal is adapted to minimize the difference between said measured tension and said reference tension, wherein it comprises the following steps:

calculating a yarn consumption speed, comparing said yarn consumption speed with a predetermined threshold speed, and if the calculated consumption speed overcomes the predetermined threshold value, enabling said tension control block, while, if the calculated consumption speed is lower than said threshold value, disabling the tension control block and maintaining the last signal generated by the latter as braking signal, until the yarn consumption speed overcomes again the threshold value.

2. The method of claim 1, wherein said tension control block is normally disabled, and is enabled by a enabling signal when the calculated consumption speed overcomes said threshold value.

3. The method of claim 1, wherein said actual consumption speed is calculated as a function of the time intervals between pulses generated by a sensor detecting the yarn loops unwinding from the feeder.

4. The method of claim 1, wherein said actual consumption speed is calculated as a function of the time intervals between pulses generated by a sensor detecting the yarn loops which are wound on the feeder.

5. An apparatus for controlling the mechanical tension of the yarn unwinding from a negative yarn-feeder for textile machines, comprising:

sensor means for measuring the yarn consumption speed, a tension sensor adapted to measure the tension of the yarn unwinding from the drum and to generate a measured tension signal, a weft-braking device arranged between said yarn-feeder and said tension sensor, a control unit connected for controlling said weft-braking device, and comprising a tension control block programmed for comparing said measured tension with a reference tension, and for transmitting a braking level signal to said weft-braking device, which braking level signal is adapted to minimize the difference between said measured tension and said reference tension, wherein said control unit comprises a speed-estimating block which processes the signals from said sensor means and is programmed for enabling said tension control block if the calculated consumption speed overcomes a predetermined threshold value, and for disabling the tension control block and maintaining the last signal generated by the latter as braking level signal, if the calculated consumption speed is lower than said threshold value, until the yarn consumption speed overcomes again said threshold value.

6. The apparatus of claim 5, wherein said tension control block is normally disabled, and said speed estimating block is programmed for generating an enabling signal enabling said tension control block when the calculated consumption speed overcomes said threshold value.

7. The apparatus of claim 5, wherein said sensor means comprise a sensor detecting the yarn loops unwinding from the feeder.

8. The apparatus of claim 5, wherein said sensor means comprise a sensor detecting the yarn loops which are wound on the feeder.

* * * * *